US007878948B2

(12) United States Patent
Chen

(10) Patent No.: US 7,878,948 B2
(45) **Date of Patent: *Feb. 1, 2011**

(54) STEPPER

(75) Inventor: Tsung-Jen Chen, Chiayi (TW)

(73) Assignee: Yu-Ting Chen, Chiayi (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/429,069

(22) Filed: Apr. 23, 2009

(65) Prior Publication Data

US 2009/0270229 A1 Oct. 29, 2009

(30) Foreign Application Priority Data

Apr. 24, 2008 (TW) ..... 97115062 A

(51) Int. Cl.
*A63B 22/04* (2006.01)

(52) U.S. Cl. ..... 482/52

(58) Field of Classification Search ..... 482/51, 482/52, 53, 54, 70, 71, 148; 434/253, 255; 601/29, 31, 34, 35; D21/670
See application file for complete search history.

(56) References Cited

U.S. PATENT DOCUMENTS

| | | | | |
|---|---|---|---|---|
| 6,955,634 | B1 * | 10/2005 | Lat | 482/71 |
| 7,465,255 | B2 * | 12/2008 | Chen | 482/53 |
| 7,637,849 | B2 * | 12/2009 | Chen | 482/52 |
| 2005/0113215 | A1 * | 5/2005 | Chuang | 482/52 |
| 2005/0124465 | A1 * | 6/2005 | Chen | 482/52 |
| 2005/0239606 | A1 * | 10/2005 | Lin | 482/52 |
| 2007/0142182 | A1 * | 6/2007 | Yang et al. | 482/52 |
| 2007/0270284 | A1 * | 11/2007 | Lin | 482/52 |
| 2008/0194387 | A1 * | 8/2008 | Chuang | 482/52 |
| 2008/0207406 | A1 * | 8/2008 | Tsai | 482/52 |

* cited by examiner

*Primary Examiner*—Loan Thanh
*Assistant Examiner*—Tam Nguyen
(74) *Attorney, Agent, or Firm*—Banger Shia

(57) ABSTRACT

A stepper includes a base, two axle units, two pedal units and a coordinating unit. The base includes a post formed thereon. Each of the axle units includes an axle extended downwards from the post. Each of the pedal units includes a pedal pivotally connected to the axle of a related one of the axle units. The coordinating unit is used to connect the pedals to each other so that one of the pedals is moved upwards and outwards while the other pedal is moved downwards and inwards.

8 Claims, 9 Drawing Sheets

STEPPER

FIELD OF INVENTION

The present invention relates to a stepper with which a user can exercise his or her legs, buttocks and waist.

BACKGROUND OF INVENTION

A conventional stepper includes two pedals that can be pivoted up and down about horizontal axles. The movement of the pedals is limited to vertical directions. Therefore, a user can only exercise his or her legs.

Another conventional stepper includes two pedals that can be pivoted about two inclined axles extended from a post. The inclined axles and the post form a Y-shaped structure. One of the pedals will be lifted and moved towards the post if the other pedal is trodden and moved away from the post, i.e., outwards. Therefore, a user is forced to twist his or her waist while exercising his or her legs by treading the pedals. The user uses a little energy to twist his or her waist because he or she easily keeps balance while moving the pedal downwards and outwards.

The present invention is therefore intended to obviate or at least alleviate the problems encountered in prior art.

SUMMARY OF INVENTION

It is the primary objective of the present invention to provide a stepper with which a user can exercise his waist, buttocks and legs at the same time.

To achieve the foregoing objective, the stepper includes a base, two axle units, two pedal units and a coordinating unit. The base includes a post formed thereon. Each of the axle units includes an axle extended downwards from the post. Each of the pedal units includes a pedal pivotally connected to the axle of a related one of the axle units. The coordinating unit is used to connect the pedals to each other so that one of the pedals is moved upwards and outwards while the other pedal is moved downwards and inwards.

Other objectives, advantages and features of the present invention will be apparent from the following description referring to the attached drawings.

BRIEF DESCRIPTION OF DRAWINGS

The present invention will be described via the detailed illustration of five embodiments referring to the drawings.

DETAILED DESCRIPTION OF EMBODIMENTS

Figure 1:
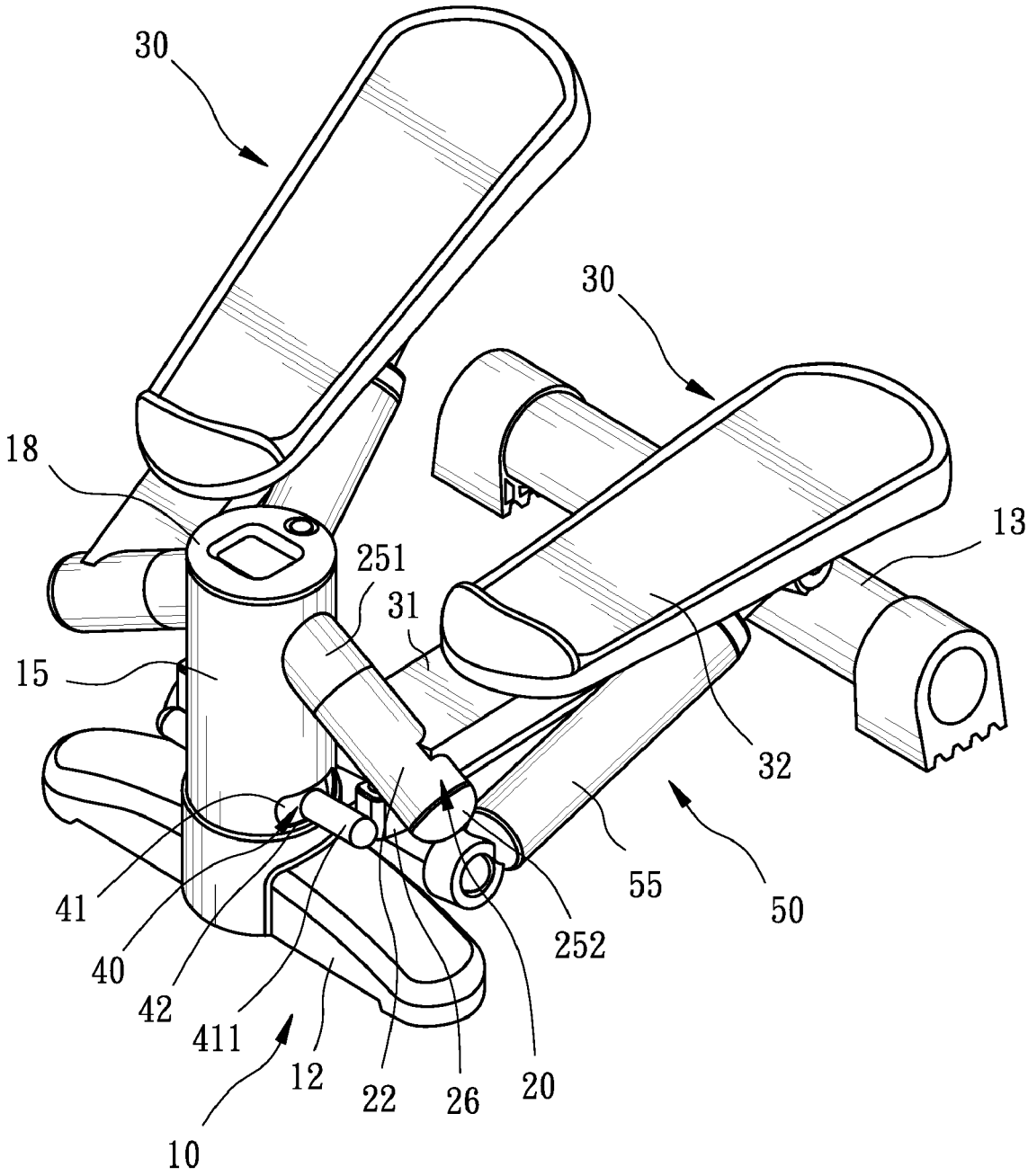
FIG. 1 is a perspective view of a stepper according to the first embodiment of the present invention.
Figure 2:
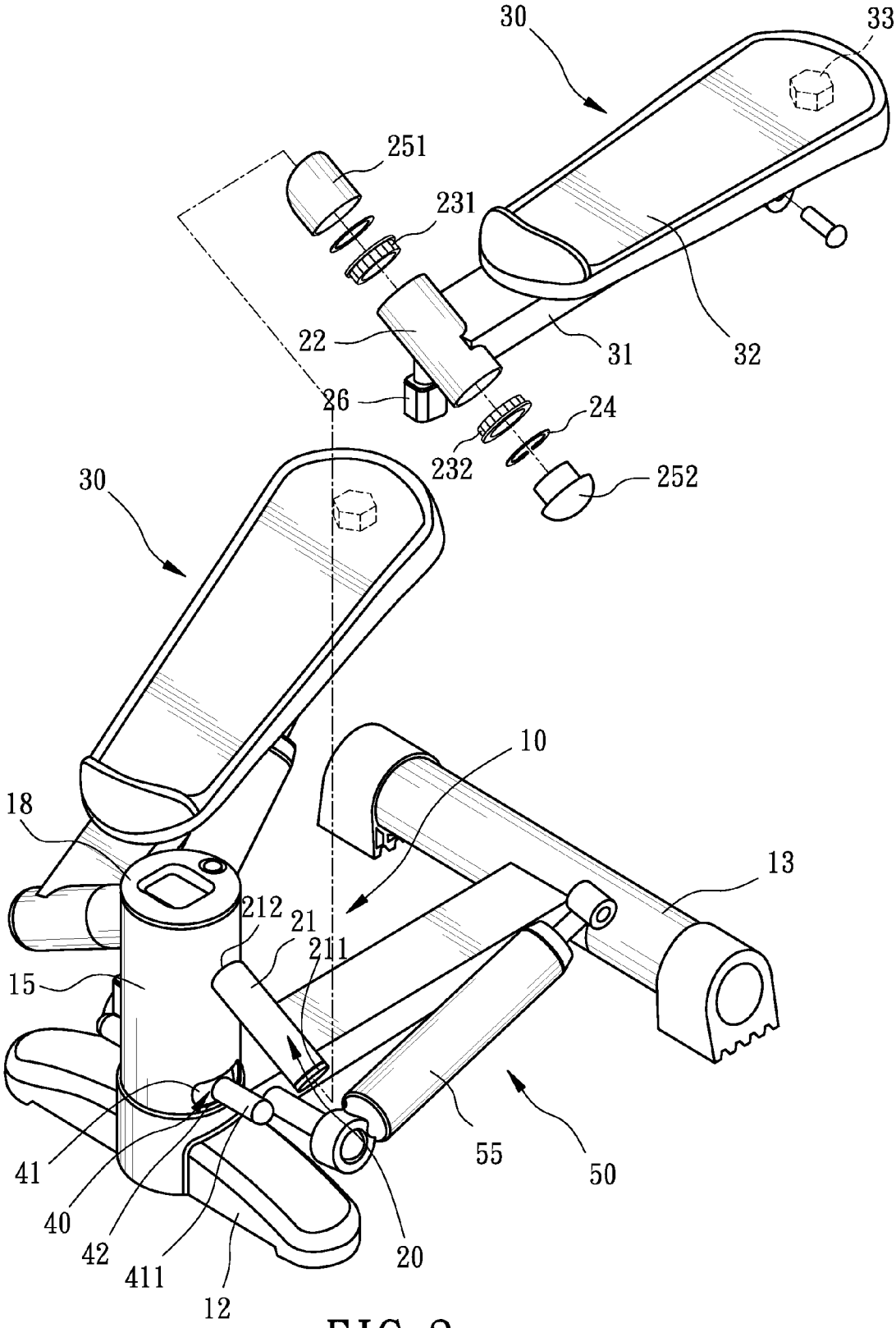
FIG. 2 is an exploded view of the stepper shown in FIG. 1.
Figure 3:
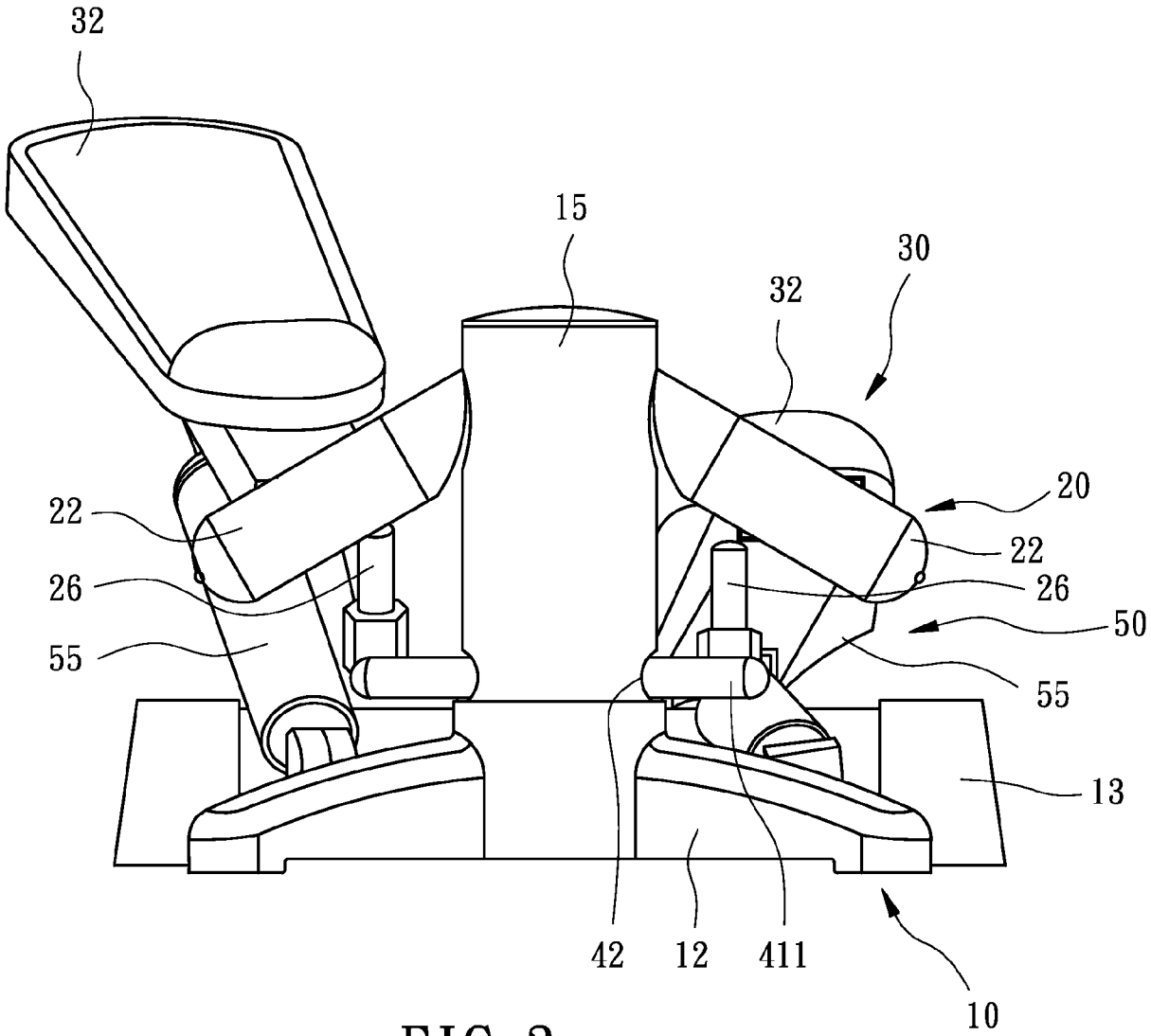
FIG. 3 is a front view of the stepper shown in FIG. 1.

Referring to FIGS. 1 through 5, a stepper includes a base 10, two axle units 20, two pedal units 30, a coordinating unit 40 and two impeding units 50 according to a first embodiment of the present invention. The base 10 includes a longitudinal bar 11 provided between two crossbars 12 and 13 and a post 15 extended from the crossbar 12. A meter 18 is provided on the post 15.

Each of the axle units 20 includes an axle 21 extended downwards from the post 15. The axle 21 includes a fixed end 212 at the post 15 and a free end 211 opposite to the fixed end 212. The free end 211 is located lower than the fixed end 212. Each of the axle units 20 includes a sleeve 22 provided around the axle 21 via two bearings 231 and 232, a spacing element 251 provided between the post 15 and the bearing 231, a clip 24 attached to the axle 21 to keep the bearings 231 and 232 and the sleeve 22 on the axle 21, a cover 252 attached to the free end 211 of the axle 21 and a rod 26 extended from the sleeve 22.

Each of the pedal units 30 includes a beam 31 connected to the sleeve 22 of a related one of the axle units 20, a pedal 32 attached to an upper side of the beam 31 and a cushion 33 attached to a lower side of the beam 31. Thus, pedal units 30 are pivotally provided on the axle units 20.

The coordinating unit 40 includes a shaft 41 rotationally inserted in the post 15 and a lever 411 connected to the post 15 so that the post 15 and the lever 411 form a cross. The lever 411 is formed with two ends each extended from the shaft 41 to the exterior of the post 15 through a slot 42 defined in the post 15. Each of the ends of the lever 411 is in contact with the rod 26 of a related one of the axle units 20.

Each of the impeding units 50 includes a rod 51 and a hydraulic cylinder 55. The rod 51 is connected to the longitudinal bar 11 transversely. The hydraulic cylinder 55 includes an end connected to the rod 51 and an opposite end connected to the beam 31 of a related one of the pedal units 30. Thus, each of the impeding units 50 is used to exert impedance against the movement of a related one of the pedal units 30.

Figure 4:
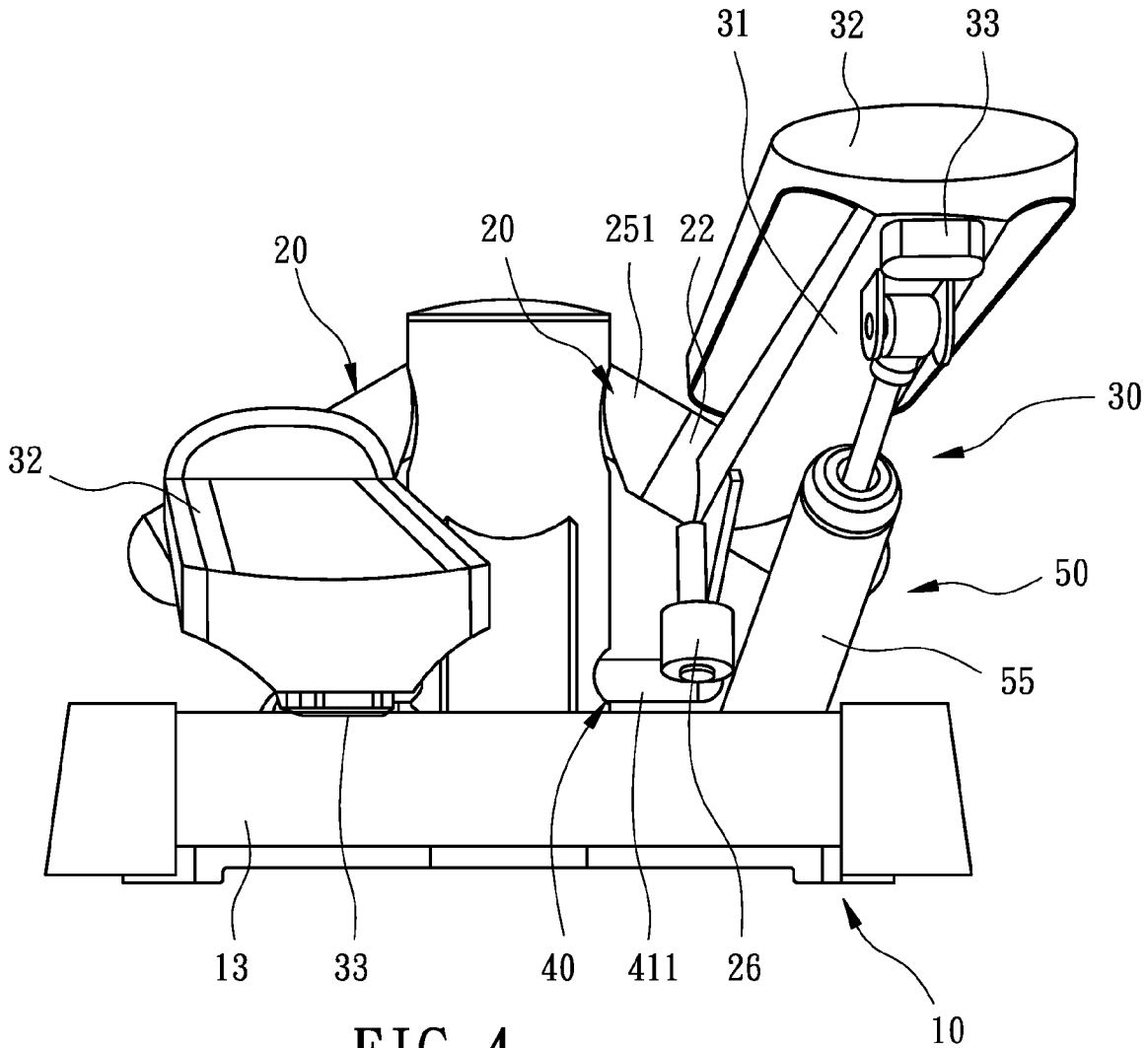
FIG. 4 is a rear view of the stepper shown in FIG. 1.
Figure 5:
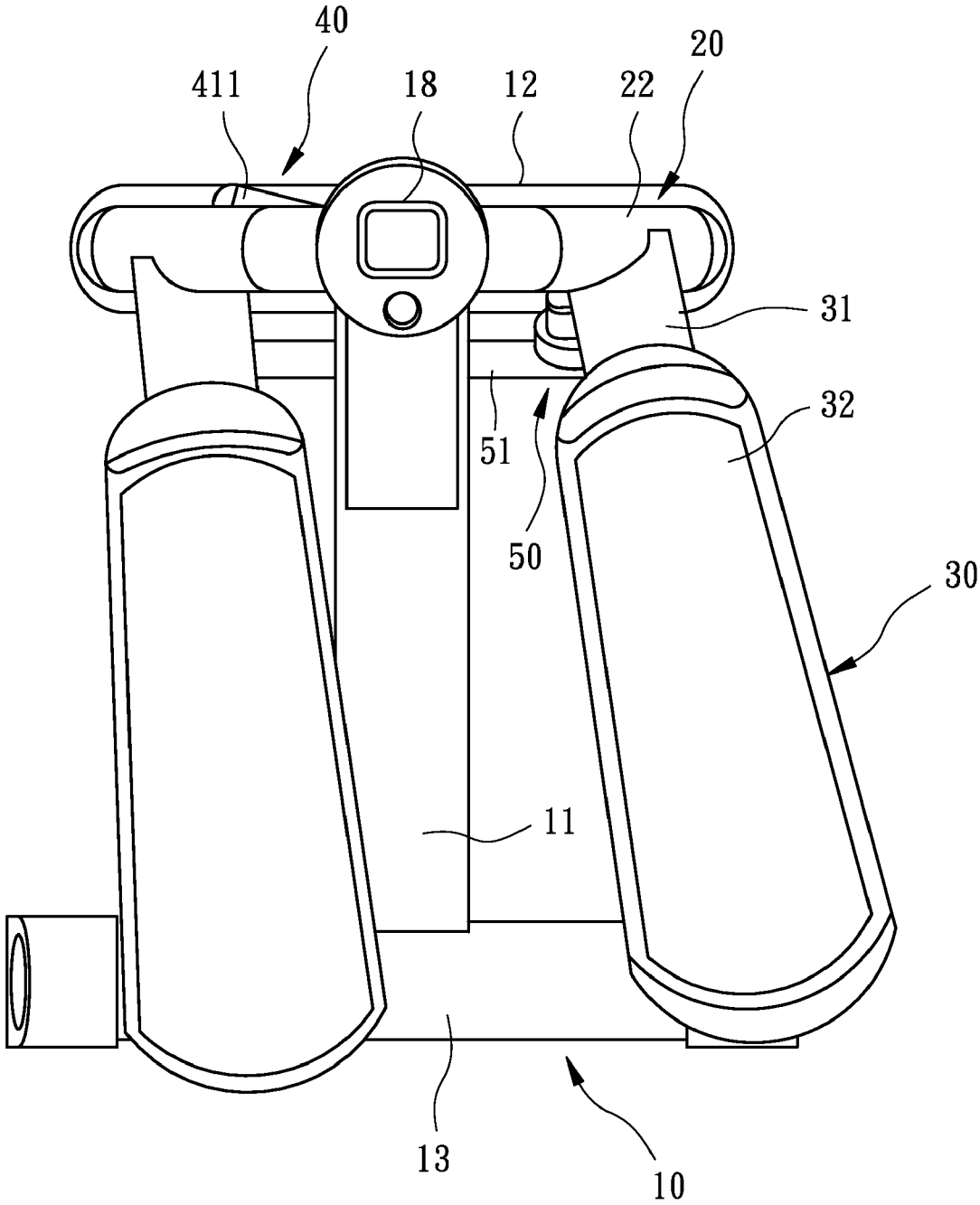
FIG. 5 is a top view of the stepper shown in FIG. 4.

Referring to FIGS. 4 and 5, the axles 21 extend downwards from the post 15 so that one of the pedals 32 is moved downwards and inwards while the other pedal 32 is moved upwards and outwards. The downward and inward movement of the each of the pedals 32 causes a user to consume a lot of energy to twist his or her waist to keep balance.

Figure 6:
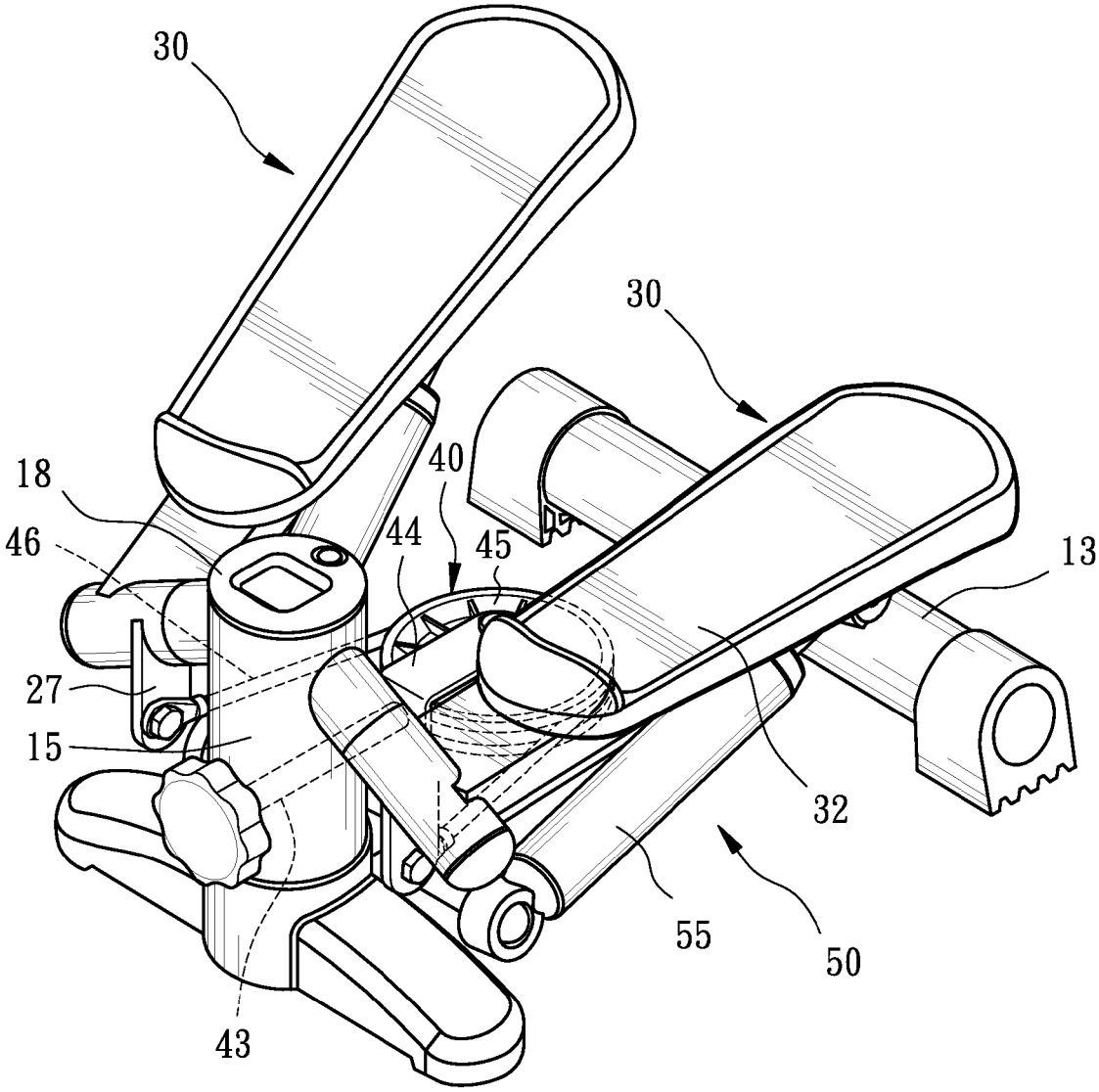
FIG. 6 is a perspective view of a stepper according to the second embodiment of the present invention.

Referring to FIG. 6, there is shown a stepper according to a second embodiment of the present invention. The second embodiment is like the first embodiment except that the coordinating unit 40 includes a rope 46 wound around a pulley 45 supported on a fork 44 attached to the post 15 with a fastener 43. The rope 46 includes two ends each tied to a connector 27 extended from a related one of the sleeves 22. With the fastener 43, it is possible to adjust the position of the fork 44 and the pulley 45.

Figure 7:
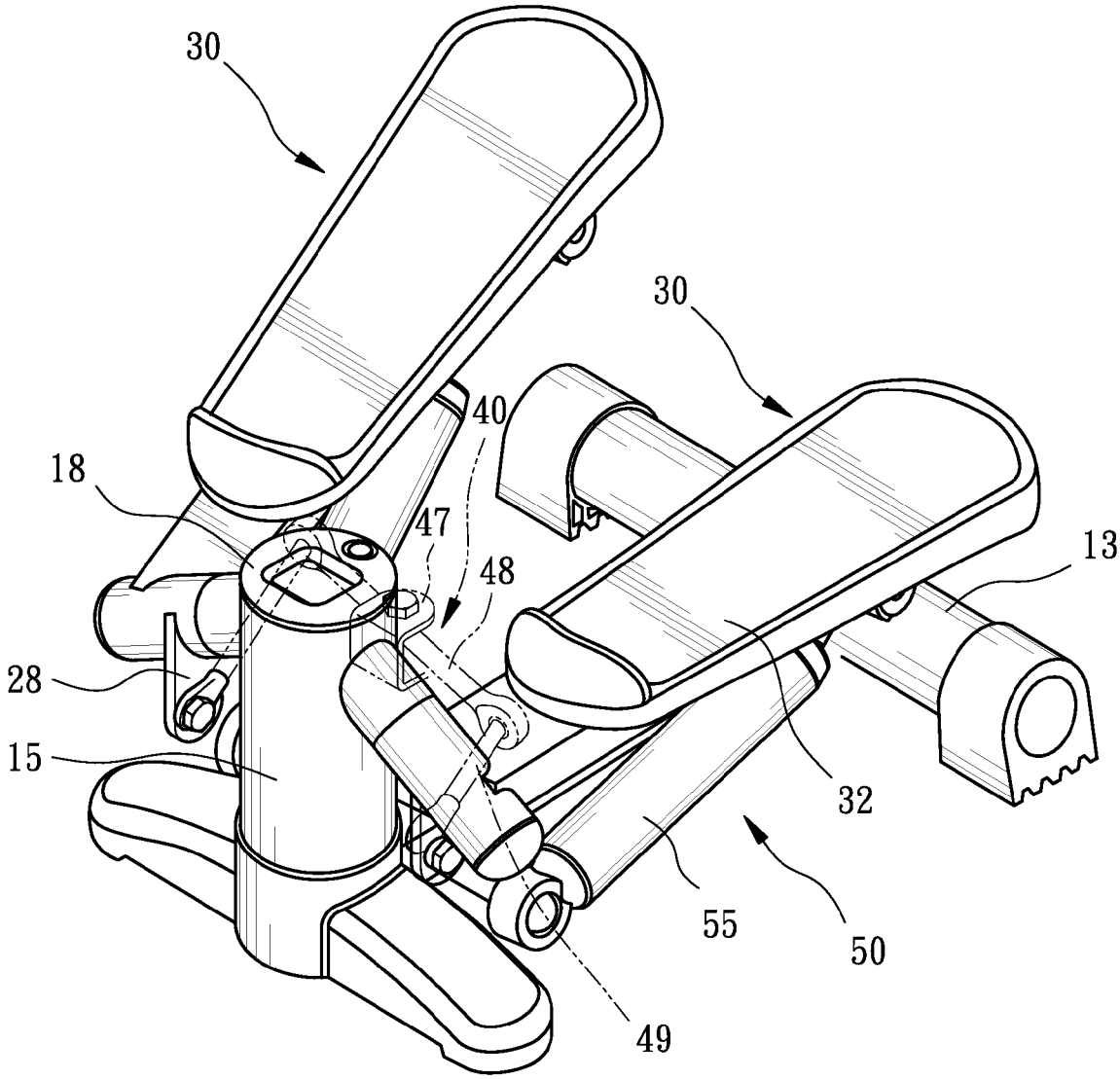
FIG. 7 is a perspective view of a stepper according to the third embodiment of the present invention.

Referring to FIG. 7, there is shown a stepper according to a third embodiment of the present invention. The third embodiment is identical to the first embodiment except that the coordinating unit 40 includes a pair of ears 47 attached to the post 15, a lever 48 pivotally connected to the pair of ears 47 and two rods 49 each connected to a connector 28 extended from a related one of the sleeves 22.

Figure 8:
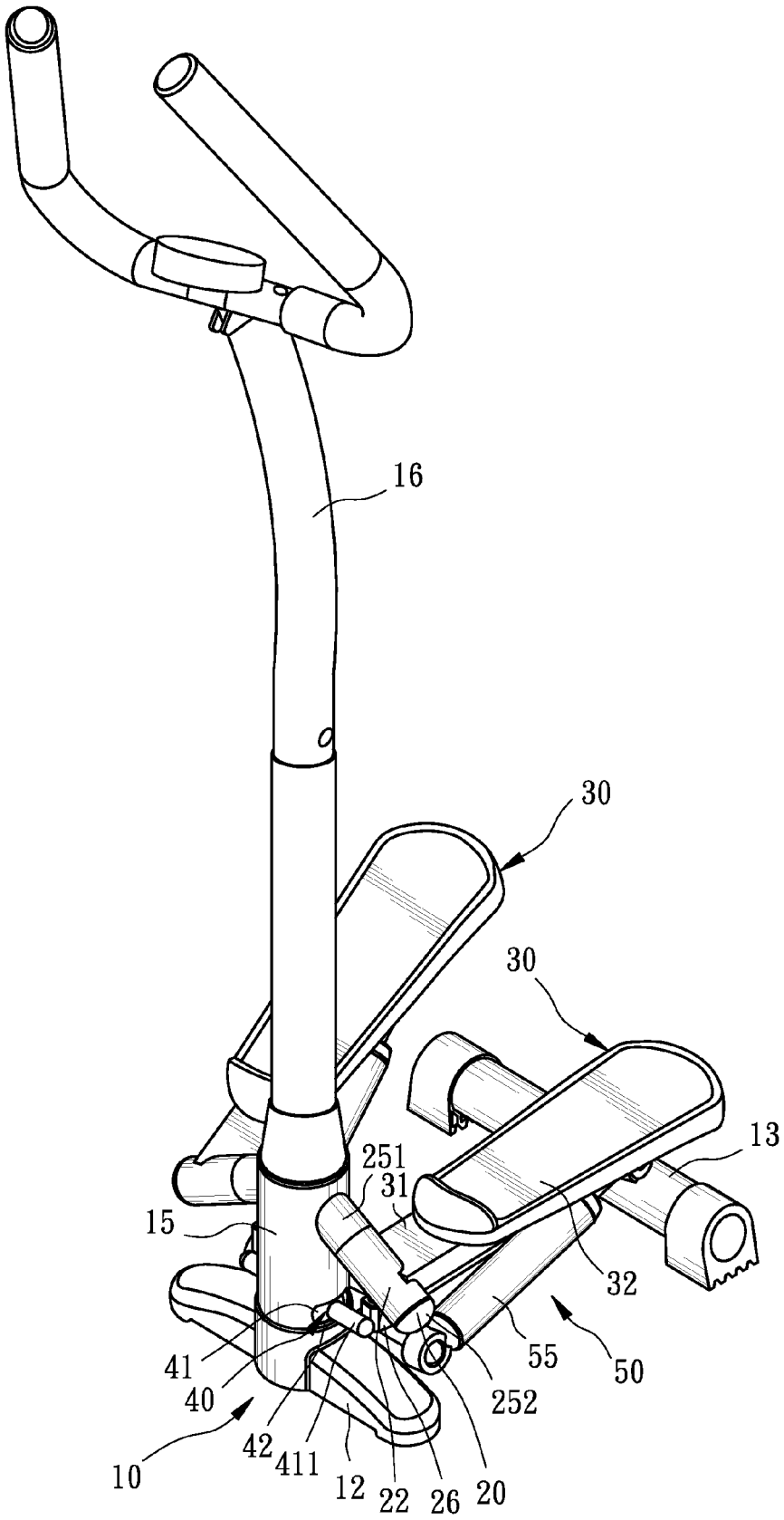
FIG. 8 is a perspective view of a stepper according to the fourth embodiment of the present invention.

Referring to FIG. 8, there is shown a stepper according to a fourth embodiment of the present invention. The fourth embodiment is like the first embodiment except including a handle 16 supported on the post 15. A child, a pregnant woven or a senior citizen can hold the handle 16 to keep balance while exercising.

Figure 9:
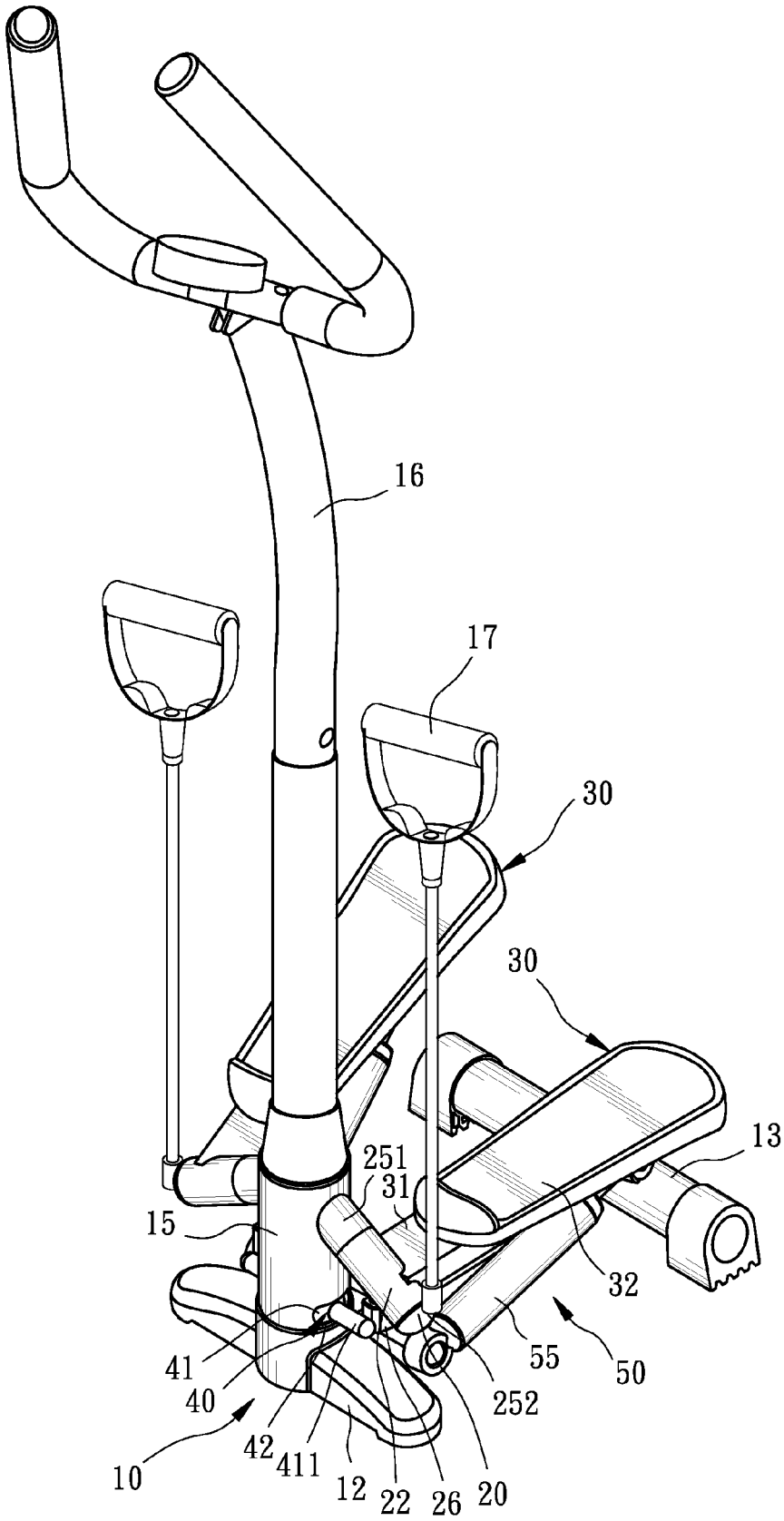
FIG. 9 is a perspective view of a stepper according to the fifth embodiment of the present invention.

Referring to FIG. 9, there is shown a stepper according to a fifth embodiment of the present invention. The fifth embodiment is identical to the fourth embodiment except including two elastic strings 17 each tied to a related one of the sleeves 22. A user can exercise his or her arms by pulling the elastic strings 17.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A stepper having an upright:

a base comprising a post formed thereon;

two axle units each having an axle extended laterally downwards from a flank of the post, a sleeve, a spacing element provided between the sleeve and the post, two bearings for supporting the sleeve on the axle, and a clip for retaining the spacing element, the sleeve and the bearings on the axle;

two pedal units each comprising a pedal connected to the sleeve of a related one of the axle units; and a coordinating unit for connecting the pedals to each other so that one of the pedals is moved upwards and outwards while the other pedal is moved downwards and inwards.

2. The stepper according to claim 1, wherein the base further comprises two crossbars and a longitudinal bar provided between the crossbars.

3. The stepper according to claim 1, wherein each of the pedal units comprises a beam for connecting the pedal to the sleeve of a related one of the axle units.

4. The stepper according to claim 1, wherein each of the pedal units further comprises a cushion attached to a lower side of the pedal.

5. The stepper according to claim 1, wherein each of the axle units further comprises a rod extended from the sleeve, the coordinating unit comprises a shaft rotationally inserted in the post and a lever is connected to the shaft and formed with two ends each extended from the shaft to the exterior of the post through a slot defined in the post so that each of the ends of the lever is in contact with the rod of a related one of the axle units.

6. The stepper according to claim 1, wherein each of the axle units further comprises a connector extended from the sleeve, and the coordinating unit comprises a fork, a fastener for attaching the fork to the post, a pulley supported on the fork and a rope wound around a pulley and formed with two ends each tied to the connector of a related one of the axle units.

7. The stepper according to claim 1, wherein each of the axle units further comprises a connector extended from the sleeve, and the coordinating unit includes a pair of ears attached to the post, a lever pivotally connected to the pair of ears and two rods each connected to the connector of a related one of the axle units.

8. The stepper according to claim 1 further comprising two impeding units each for exerting impedance against the movement of the pedal of a related one of the pedal units.

* * * * *